US012668930B2

(12) United States Patent
Barragan

(10) Patent No.: US 12,668,930 B2
(45) Date of Patent: Jun. 30, 2026

(54) CONCRETE QUICK SNAP APPARATUS

(71) Applicant: Smooth Style Concrete Construction, Inc., Windsor, CA (US)

(72) Inventor: Hector Barragan, Windsor, CA (US)

(73) Assignee: Smooth Style Concrete Construction, Inc, Windsor, CA (US)

( * ) Notice: Subject to any disclaimer, the term of this patent is extended or adjusted under 35 U.S.C. 154(b) by 377 days.

(21) Appl. No.: 18/587,395

(22) Filed: Feb. 26, 2024

(65) Prior Publication Data

US 2024/0295083 A1 Sep. 5, 2024

Related U.S. Application Data

(60) Provisional application No. 63/449,382, filed on Mar. 2, 2023.

(51) Int. Cl.
*E01C 11/06* (2006.01)

(52) U.S. Cl.
CPC ..... *E01C 11/06* (2013.01)

(58) Field of Classification Search
CPC ..... E01C 11/06
USPC ..... 404/83, 89
See application file for complete search history.

(56) References Cited

U.S. PATENT DOCUMENTS 2,351,175 A * 6/1944 Wilhelm ..... B28D 1/088 299/35
2,860,862 A * 11/1958 Horton ..... B28D 1/088 299/35
2005/0229915 A1* 10/2005 VanGundy ..... B28B 11/14 125/21

FOREIGN PATENT DOCUMENTS

EP 3705250 B1 * 5/2022 ..... B29C 64/106

* cited by examiner

*Primary Examiner* — Raymond W Addie
(74) *Attorney, Agent, or Firm* — Christopher Pilling

(57) ABSTRACT

A concrete quick snap apparatus and a method for creating control joints in concrete surfaces is provided The apparatus includes a cylindrical housing with a hollow interior, designed to accommodate a snap line, and a flat flanged bottom surface that acts as a guide for positioning. The housing features a small hole at one end for attaching the snap line and an opening with an attachment hole at the opposite end for connecting to one or more extendable support elements like extension poles. The invention includes a snap line holster, which stores the snap line and can be inserted within the housing for storage or transport. The method involves attaching the snap line to the housing, extending the apparatus with the extension poles to reach the desired location, and using the snap line to create a control joint in the concrete. This apparatus and method facilitate the creation of control joints in freshly poured concrete and in hard-to-reach areas, improving efficiency and precision in concrete construction.

3 Claims, 6 Drawing Sheets

CONCRETE QUICK SNAP APPARATUS

CROSS-REFERENCE TO RELATED APPLICATIONS

The present invention claims priority to U.S. Provisional Application Ser. No. 63/449,382 filed Mar. 2, 2023, which is hereby incorporated in its entirety at least by reference.

BACKGROUND OF THE INVENTION

1. Field of the Invention

The present invention relates generally concrete tools but more particularly a concrete quick snap apparatus for quickly cutting control joints.

2. Description of Related Art

Concrete expands and contracts with changes in temperature and moisture. If not properly controlled, cracks can begin to appear. Placement of concrete control joints and expansion joints are crucial when designing and pouring concrete slabs and sidewalks. The control joints provide a gap allowing each adjacent slab of concrete to move independently and freely from one another. As well known in the art, currently, you must wait for the concrete to harden enough to use knee boards or 2'×4' boards to walk and physically cut the control joints by hand. This process is slow, and can lead to imperfections in the concrete before it sets. Consequently, a solution is needed.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main object of the present disclosure to provide a concrete quick snap for efficiently and easily cutting control joints in concrete without damaging or causing imperfections in the concrete while it sets or hardens.

In order to do so an apparatus is provided, comprising a housing; a string line holster having string (snap line); and extension pole.

In another aspect of the invention, a method for creating control joints in concrete is provided, comprising steps: (a) providing a cylindrical housing having a flat guide with a small hole at one end of the housing and an opening and an attachment hole at the other end of the housing; (b) attaching string to the small hole, wherein the string is wound on a string holster; (c) attaching the housing to one or more extension poles; (d) using the flat guide with the attached extension pole to reach and place the flat guide at one end of a desired control joint, and having the string holster such that the string is extended from the small hole to the user extending the extension pole; and (e) snapping the control joints, via the string, in freshly laid concrete.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figure 1A:
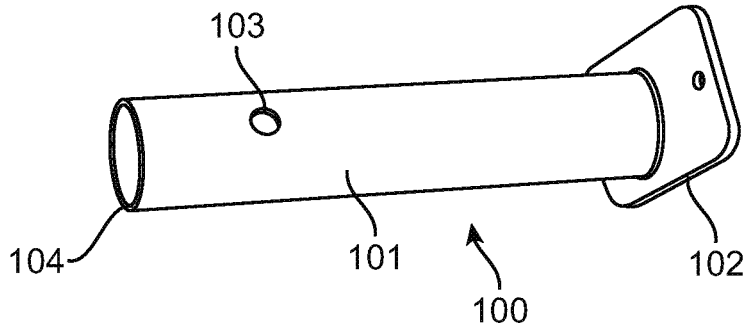
FIGS. 1A-B are various views of the housing of the concrete quick snap apparatus according to an embodiment of the present invention.
Figure 1B:
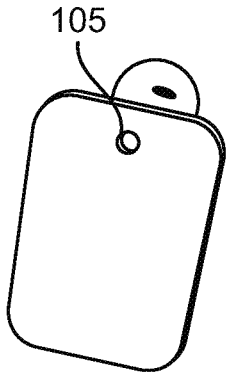

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a concrete quick snap apparatus.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about", "generally", or "approximately" apply to all numeric values, whether or not explicitly indicated. These terms generally refer to a range of numbers that one of skill in the art would consider near the stated amount by about 0%, 5%, or 10%, including increments therein. In many instances these terms may include numbers that are rounded to the nearest significant figure.

Referring now to any of the accompanying FIGS. 1-6, the concrete quick snap apparatus is shown. FIGS. 1A-B, show the housing 100 of the concrete quick snap apparatus. In one embodiment, the housing 100 comprises a hollow cylinder 101 having a flat flanged bottom surface 102 at one end of the cylinder and an opening 104 at the other end. In some embodiments, towards the opening 104, is an attachment hole 103 which will be described in further details below. The flat flanged bottom surface 102 includes a small hole 105 configured to enable the tying of snap line string 200, which will be described below.

Figure 2A:
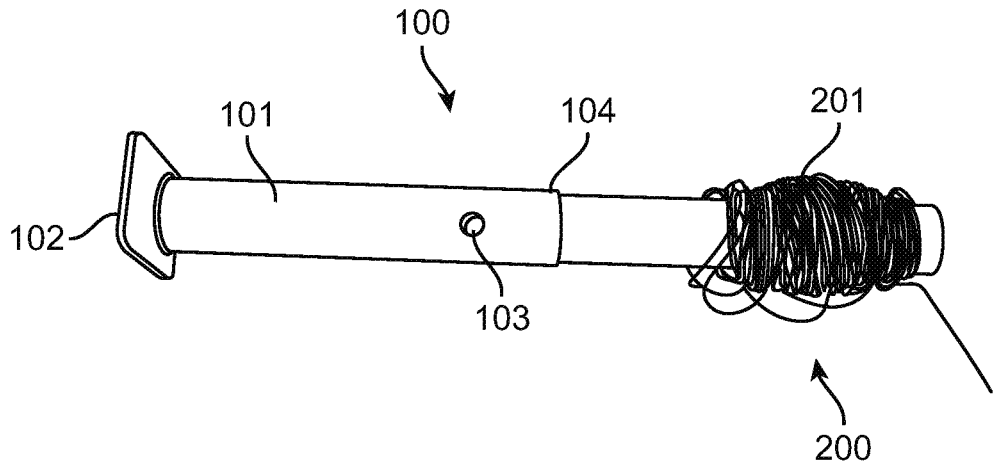
FIGS. 2A-B are various views of the holster line within the housing for storage according to an embodiment of the present invention.
Figure 2B:
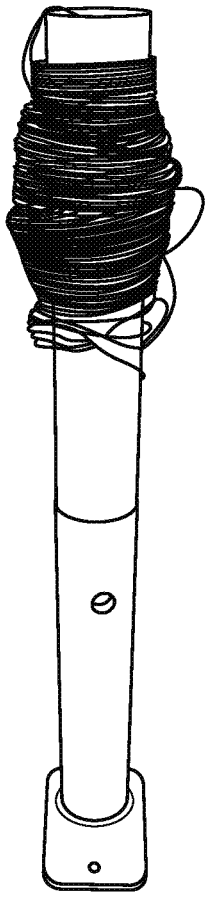
Figure 3:
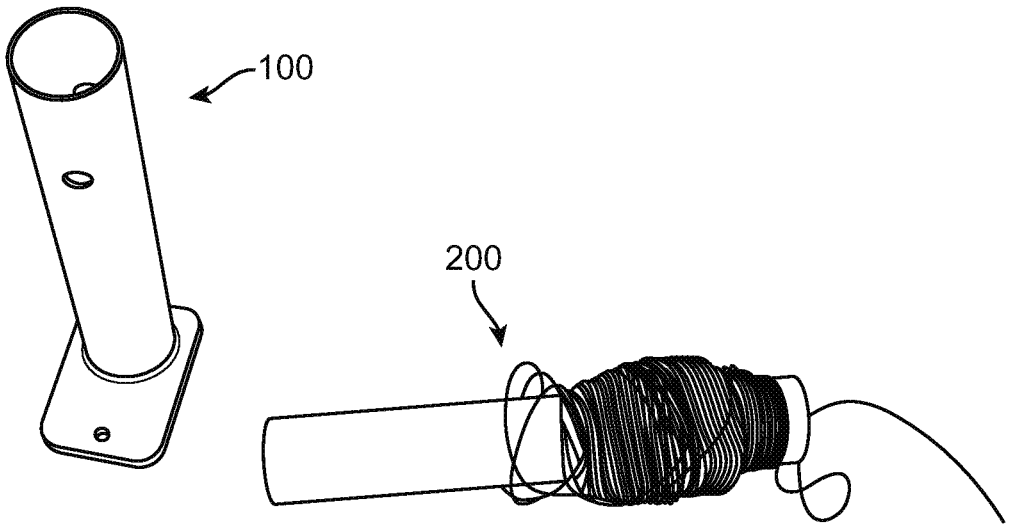
FIG. 3 shows the holster line and the housing of the concrete quick snap apparatus according to an embodiment of the present invention.

FIGS. 2A-B and FIG. 3 introduce the string line holster 200 which has a line of string (snap line) 201 wound to its cylinder. When the apparatus is in storage, transport, etc. the string line holster 200 may be inserted within the cylinder of the housing 100 (as seen in FIGS. 2A-B).

Figure 4A:
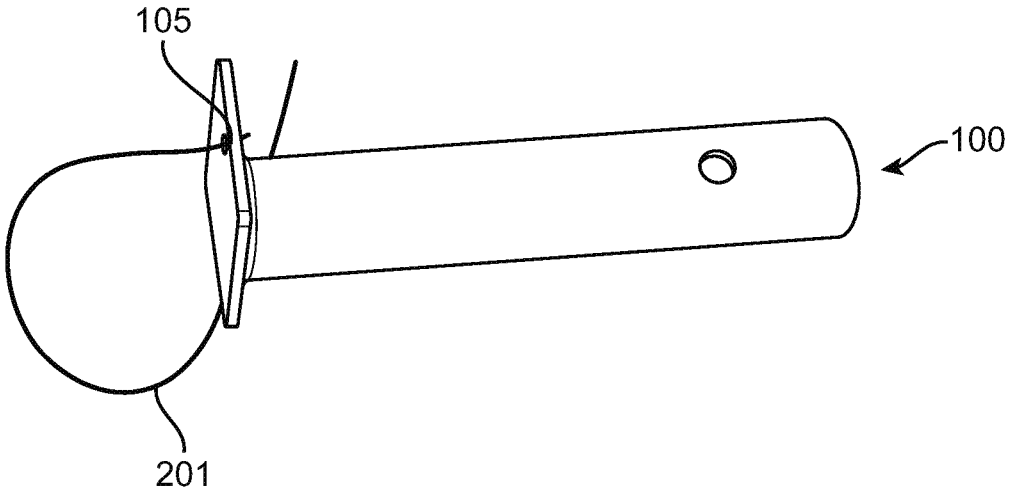
FIGS. 4A-B are various views showing the attachment of string to the housing according to an embodiment of the present invention.
Figure 4B:
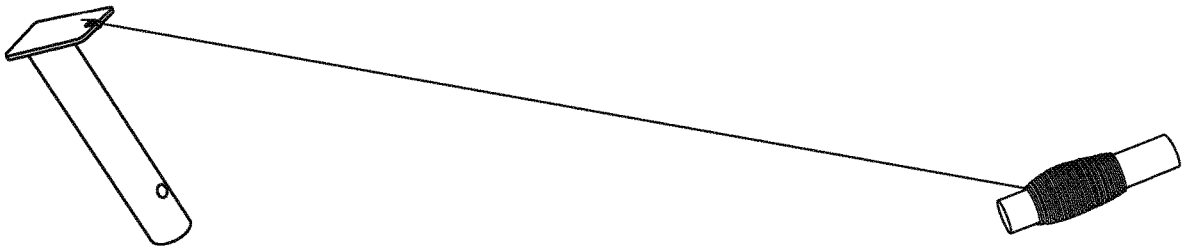
Figure 5A:
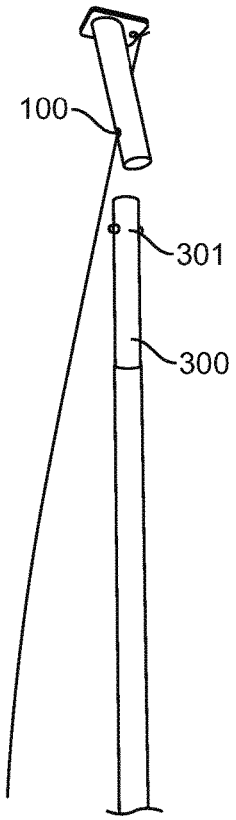
FIGS. 5A-B shows the housing with the attached string being attached to an extension pole according to an embodiment of the present invention.
Figure 5B:
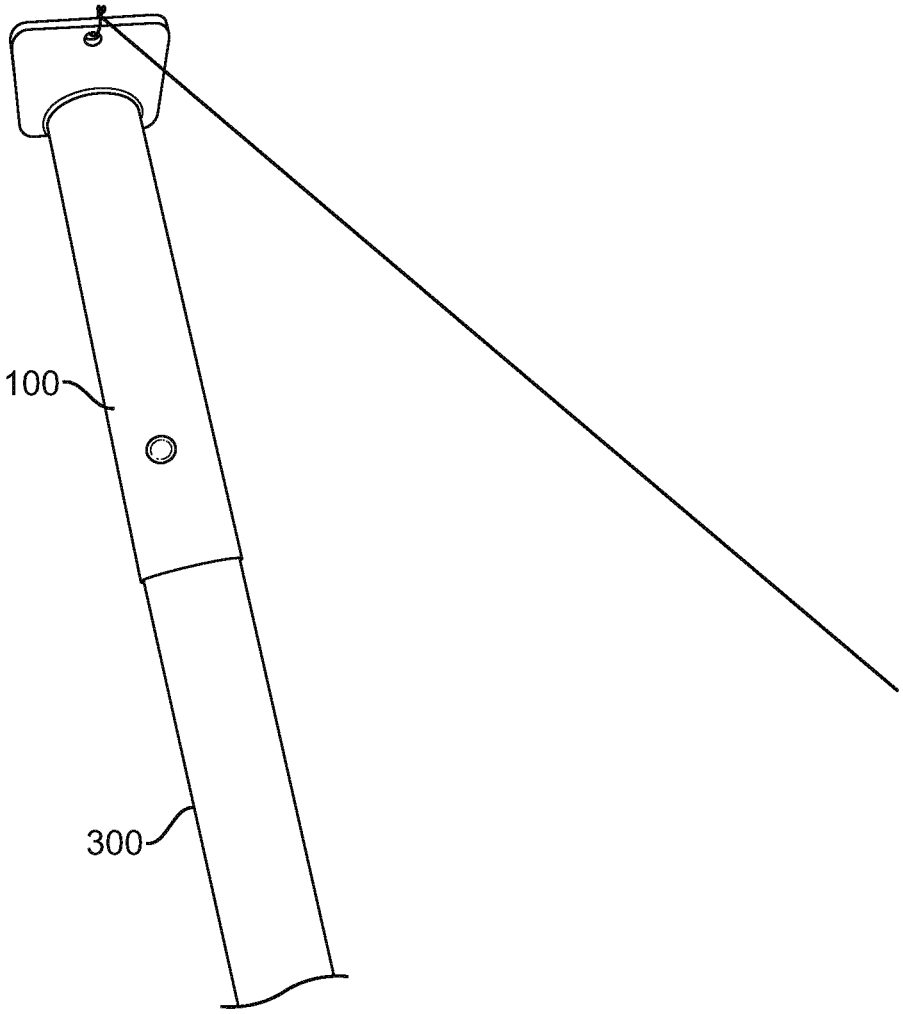

FIGS. 4A-B show the string line (snap line) 201 being threaded in the small hole 105 on the housing, then tied to connect an end of the string line to the housing. In FIGS. 5A-B, the housing with attached snap line is attached to an extension pole 300. The means of the attachment may vary as well known in the art. In one embodiment, the end of the extension pole 300 comprises a telescoping push button/pin 301 configured to be positioned in attachment hole 103 of the housing 101 securing the housing to the attachment pole. It should be understood, multiple extension poles 300A, 300B (best seen in FIG. 6) may be used to extend the length of the apparatus, depending on the distance required to reach for the end of the snap line.

Figure 6:
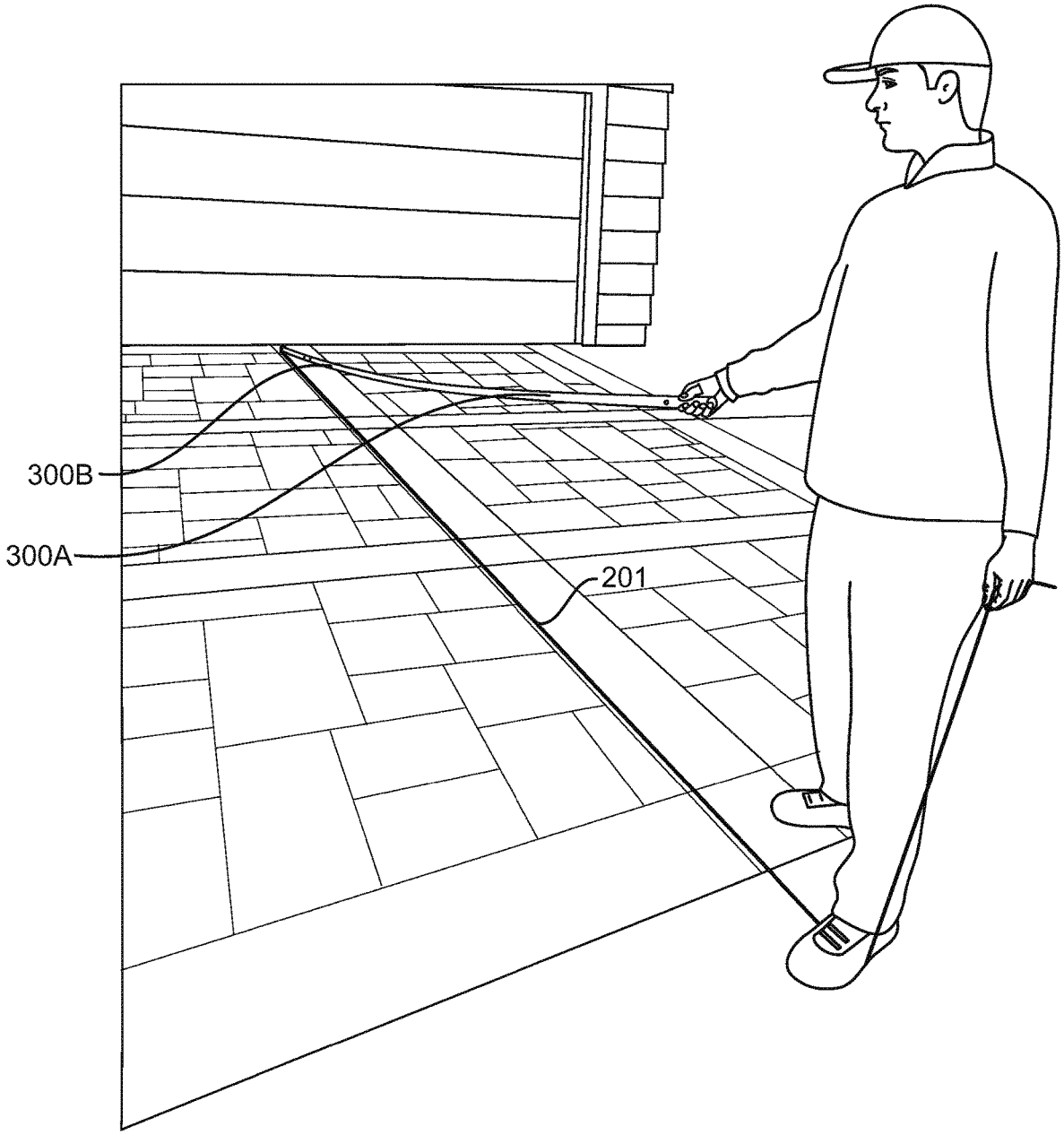
FIG. 6 shows the concrete quick snap apparatus in use according to an embodiment of the present invention.

Best seen in FIG. 6, a user using the apparatus extends the housing, via one or more extension poles, such that the flat bottom flange (acting as a guide) sits beyond or at one end of a desired control joint. Using the snap line, the user extends the line via the slack of the line or holster into position, then snaps the line to create a control joint at the desired location at a length between the user and the housing. This prevents a worker from having to physically be positioned at the end where the housing is located. Advantageously, the control joints can be created on freshly poured concrete and hard to reach areas.

It should be understood that the material selection of the apparatus may vary. In some embodiments, the housing, extension pole, and holster is constructed from aluminum. In other embodiments, the apparatus may be constructed from stainless steel. In yet other embodiments, a plastic material for the apparatus is used. In some embodiments, the string line (snap line) is nylon.

In another aspect of the invention, a method for creating control joints in concrete is provided, comprising steps: (a) providing a cylindrical housing having a flat guide with a small hole at one end of the housing and an opening and an attachment hole at the other end of the housing; (b) attaching string to the small hole, wherein the string is wound on a string holster; (c) attaching the housing to one or more extension poles; (d) using the flat guide with the attached extension pole to reach and place the guide at one end of a desired control joint, and having the string holster such that the string is extended from the small hole to the user extending the extension pole; and (e) snapping the control joints, via the string, in the freshly laid concrete.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A concrete quick snap apparatus comprising:

a housing having a hollow interior and an end portion configured to guide the apparatus against or beyond a desired control joint on a concrete surface, and an opening with an attachment hole at the opposite end;

a string line holster with a snap line wound around a cylinder;

a snap line connection mechanism on the housing configured to enable the attachment of the snap line to the housing;

an attachment mechanism for securing the housing to one or more extension poles, wherein each extension pole comprises a telescoping push button/pin configured to engage with an attachment hole of the housing for securing the housing to the extension pole.

2. An apparatus for creating control joints in concrete, comprising:

a housing configured to be handheld, with an internal cavity and an external surface designed for ease of handling;

a snap line connection mechanism on the housing configured to enable the attachment of a snap line to the housing;

an attachment system for removably coupling the housing to one or more extendable support elements, facilitating the extension of the apparatus to reach various distances;

wherein the apparatus is structured to enable the positioning of a snap line at a desired location for creating control joints in concrete surfaces, including freshly poured concrete and hard-to-reach areas.

3. A method, comprising steps:

(a) providing an apparatus comprising a housing and an external surface designed for ease of handling;

(b) attaching one end of a snap line to the housing;

(c) removably coupling the housing to one or more extendable support elements to facilitate the extension of the apparatus to various distances;

(d) extending the apparatus using the one or more extendable support elements to position the housing at one end of a desired location for a control joint in a concrete surface;

(e) extending the snap line from the housing to the user;

(f) snapping the snap line against the concrete surface to create a control joint at a location between the user and the housing, thereby enabling the formation of control joints in freshly poured concrete and in hard-to-reach areas.

* * * * *